US012729586B1

(12) United States Patent
Blens

(10) Patent No.: US 12,729,586 B1
(45) Date of Patent: Sep. 8, 2026

(54) CONSTRUCTION MACHINE AND METHOD FOR CARRYING OUT A CONSTRUCTION WORK STEP

(71) Applicant: Klemm Bohrtechnik GmbH, Drolshagen (DE)

(72) Inventor: Jochen Blens, Drolshagen-Schreiberhof (DE)

(73) Assignee: Klemm Bohrtechnik GmbH, Drolshagen (DE)

( * ) Notice: Subject to any disclaimer, the term of this patent is extended or adjusted under 35 U.S.C. 154(b) by 0 days.

(21) Appl. No.: 19/268,381

(22) Filed: Jul. 14, 2025

(30) Foreign Application Priority Data

Mar. 10, 2025 (EP) ..... 25162715

(51) Int. Cl.
*E21B 7/02* (2006.01)
*E21B 15/04* (2006.01)

(52) U.S. Cl.
CPC ..... *E21B 7/024* (2013.01); *E21B 15/045* (2013.01)

(58) Field of Classification Search
CPC . E21B 7/024; E21B 7/022; E21B 7/02; E21B 15/045
See application file for complete search history.

(56) References Cited

U.S. PATENT DOCUMENTS 3,809,344 A * 5/1974 Kolderup ..... E21B 7/025 173/28
5,213,169 A * 5/1993 Heller ..... E21B 21/12 175/215

(Continued)

FOREIGN PATENT DOCUMENTS

AT 503730 A2 * 12/2007
CN 106194019 A * 12/2016 ..... E21B 7/023

(Continued)

OTHER PUBLICATIONS

The extended European search report issued by the European Patent Office on Aug. 1, 2025, which corresponds to European Patent Application No. 25162715.4-1005 and is related to U.S. Appl. No. 19/268,381.

*Primary Examiner* — Daniel P Stephenson

(74) *Attorney, Agent, or Firm* — Studebaker Brackett PLLC

(57) ABSTRACT

Construction machine, in particular drilling rig, with a construction working device for carrying out a work step, with a carriage, along the carriage longitudinal axis of which the construction working device is mounted so as to be axially displaceable, a carrier device with a running gear for moving the construction machine, and an adjusting device, by means of which the carriage is arranged adjustably at the front side of the carrier device. The construction machine is characterized in that the adjusting device comprises a first base plate, which is connected to the carrier device, and a second base plate, which is connected to the carriage, in that the first base plate and the second base plate are arranged at a distance from one another, wherein actuating elements are arranged between the two base plates, which connect the two base plates to one another, and in that the actuating elements are linearly adjustable and actuatable, wherein the base plates are adjustable relative to one another in three dimensions.

15 Claims, 2 Drawing Sheets

(56) References Cited

U.S. PATENT DOCUMENTS

| | | | | |
|---|---|---|---|---|
| 5,394,949 | A * | 3/1995 | Wright | E21B 7/006 175/203 |
| 8,113,299 | B2 * | 2/2012 | Wrede | E21B 15/04 175/57 |
| 8,215,199 | B2 * | 7/2012 | Marcroft | B25J 17/0216 74/490.13 |
| 2003/0047359 | A1 * | 3/2003 | Shupe | E21B 7/025 175/162 |
| 2006/0185904 | A1 * | 8/2006 | Comacchio | E21B 15/04 175/122 |
| 2010/0065335 | A1 * | 3/2010 | Wrede | E21B 7/025 175/220 |
| 2013/0297046 | A1 * | 11/2013 | Hendron | E04G 21/0463 700/56 |
| 2021/0025235 | A1 * | 1/2021 | Hagemeyer | E21B 7/026 |
| 2021/0239574 | A1 * | 8/2021 | Trächtler | G01M 17/04 |

FOREIGN PATENT DOCUMENTS

| | | | | |
|---|---|---|---|---|
| DE | 10-2008-037339 | A1 | 2/2010 | |
| DE | 11-2006-001920 | B4 | 10/2013 | |
| DE | 20 2014 000 508 | U1 | 2/2014 | |
| DE | 202022003097 | U1 * | 10/2024 | E21B 3/035 |
| EP | 3719247 | A1 | 10/2020 | |
| GB | 1234981 | A * | 6/1971 | E21B 7/022 |
| NL | 2015790 | B1 * | 6/2017 | B66F 7/20 |

* cited by examiner

CONSTRUCTION MACHINE AND METHOD FOR CARRYING OUT A CONSTRUCTION WORK STEP

TECHNICAL FIELD

The invention relates to a construction machine, in particular a drilling rig, with a construction working device for carrying out a construction work step, with a carriage along the carriage longitudinal axis of which the construction working device is mounted so as to be axially displaceable, a carrier device with a running gear for moving the construction machine, and an adjusting device by means of which the carriage is arranged adjustably at the front side of the carrier device.

The invention further relates to a method for carrying out a construction work step.

BACKGROUND

Generic construction machines have been known for a long time, for example from DE 20 2014 000 508 U1. These are often used as so-called anchor drilling rigs, with which ground anchors are inserted into vertical or inclined soil or rock walls in order to tie back these walls and possibly supporting wall elements provided on them. For operational reasons, these drilling rigs are usually operated on unpaved and sloping surfaces. However, the holes should be drilled into the wall at a fixed angle to the horizontal or to the wall at a fixed point, the so-called drilling starting point.

In order to be able to adjust this fixed angle, such drilling rigs have a mechanical adjusting device, also known as a kinematic assembly. These comprise several movement axes, i.e. rotation and translation axes, so that the carriage with the drilling tool can be positioned at the desired angle at the drilling starting point. This arrangement is achieved by actuating the various movement axes of the adjusting device in series. In this context, it is referred to as serial kinematics. This ensures precise positioning of the carriage at different positions of the drilling tool in relation to the drilling starting point.

However, multi-axis control of a construction working device by means of serial kinematics requires various actuating elements, which are connected to form a complex adjusting device. This increases the weight of the adjusting device and requires a larger installation space. Furthermore, the adjusting device exhibits reduced rigidity and increased mass inertia as the number of adjustment axes increases, which has a negative effect on the dynamic properties and reduces a possible payload.

SUMMARY

The object underlying the invention is to specify a construction machine and a method for this purpose, which enable more efficient use in the site with a compact and lightweight structure.

The construction machine according to the invention is characterized in that the adjusting device comprises a first base plate, which is connected to the carrier device, and a second base plate, which is connected to the carriage, in that the first base plate and the second base plate are arranged at a distance from one another, wherein actuating elements are arranged between the two base plates, which in each case connect the two base plates to one another, and in that the actuating elements are linearly adjustable and actuatable, wherein the base plates are adjustable relative to one another in three dimensions.

A first basic idea of the invention can be considered in that to enable spatial adjustability of the base plates relative to one another in as many rotational and translational degrees of freedom as possible, by an arrangement of several linearly adjustable and actuatable actuating elements between two base plates.

Another basic idea of the invention can be seen in the fact that an adjusting device constituted of linearly adjustable and actuatable actuating elements is particularly compact and has a lower mass compared to conventional adjusting devices, and loads can be distributed more uniformly among each other.

A particularly advantageous embodiment of the invention can be achieved by actuating the individual actuating elements kinematically in parallel. In this case, the movement axes are connected in parallel. This avoids that one drive have to move the next one, as is the case with serial kinematics. This improves the dynamics of the system.

Another practical arrangement can be achieved by forming a so-called hexapod with the actuating elements. In this type of assembly, six actuating elements are arranged between the base plates with a certain positioning angle in relation to the base plates. This makes it possible to achieve a particularly advantageous arrangement with high dynamics and positioning accuracy. The hexapod allows movement in all six degrees of freedom. Furthermore, depending on the desired dimensions and application, arrangements with more or less than six actuating elements, such as a pentapod with five or a tripod with three, can be used.

Furthermore, it may be preferable for the actuating elements to be connected to the each adjacent base plates via joints with several axes of movement, in particular ball-and-socket joints or cardanic joints. Both the number and type of joints can be selected and combined in such a way thereby that the required degrees of freedom can be achieved with simultaneous optimum dynamic properties. Furthermore, other types of joints, such as simple swivel joints, shear joints or combinations of these, can also be used. According to a particularly advantageous embodiment of the invention, the actuating elements together with their joints can be displaceably mounted at the end. This means that the basic positions can be adjusted either manually in advance or automatically or dynamically during use.

According to a further embodiment of the invention, it may be advantageous for the construction machine to comprise at least six identical actuating elements, which at one end are each articulated in pairs on three distributed areas of the first base plate and are each articulated in pairs at the other end on three distributed areas of the second base plate, wherein two actuating elements articulated in one area are each arranged in a V-shape relative to each other. In such an arrangement, the position of the second base plate is not described in the form of vector coordinates, but as a set of control values of the actuating elements.

It may also be preferable for the actuating elements to be designed as hydraulic actuating cylinders. Hydraulic actuating cylinders enable a high force density, such as is required for drilling or other civil engineering work. Despite the high force development, they can be adjusted very precisely. Furthermore, hydraulic actuating cylinders require little maintenance effort, which is of advantage for particularly complex machines.

According to a possible embodiment of the invention, it is also preferred that the actuating elements are designed as electromechanical actuating cylinders. Electromechanical actuating cylinders allow exact positioning and repeat accuracy through the use of servomotors and high-resolution sensors, for example, which is why they are suitable for particularly precise work. Compared to hydraulic positioning systems, they also do not require hydraulic fluid, which eliminates the risk of leaks and contamination. Electromechanical actuating cylinders only require electricity when they need to be moved. This also makes them particularly energy-efficient and quiet. They can also be controlled directly via electrical signals, eliminating the need for hydraulic units or pipelines on the one hand and making it easier to connect them to control systems on the other hand.

In addition to hydraulic and electromechanical systems, other actuator types such as pneumatic, piezoelectric or magnetic drives can also be used.

A particularly advantageous actuation of the adjusting device can be achieved in that the construction machine comprises a control device into which a position and/or orientation of the second base plate in space can be input and preset, and in that the control device is configured to actuate the actuating elements in such a way that the second base plate takes the preset position and/or orientation. For this purpose, the control device can preferably be configured with an input device on the construction machine or on an external terminal device, via which a position and/or orientation of the second base plate can be input. Furthermore, it may also be preferred that a position and/or orientation of the construction working device, specified by parameters such as coordinates of a tool center point and an angle, can be input, based on which the control device determines the position and/or orientation of the second base plate and controls the actuating elements accordingly in order to set them.

According to a further preferred embodiment of the invention, the construction machine comprises a control device which is configured to maintain a position and/or orientation of the second base plate in space even if the position of the carrier vehicle changes. In this way, the construction working device can be held in position even if the carrier vehicle slips or is repositioned, for example. Otherwise, the work step would have to be interrupted to reorientate the construction machine.

A further advantageous configuration can be achieved by designing the carrier device as a crawler-type vehicle with lateral crawler tracks.

A particularly suitable arrangement can result from the fact that the crawler tracks are articulated to the carrier device so as to be adjustable about a transverse axis of the carrier device. In particular, a swinging suspension of the crawler tracks is possible, so that a further site slope of the carrier device can be compensated by a corresponding adjustment of the crawler tracks around the transverse axis.

It may also be preferable for the construction machine to be designed as a drilling rig, wherein the construction working device comprises a drilling drive for rotatably driving a rod-shaped drilling element.

Furthermore, a particularly advantageous embodiment of the method consists in that a rod-shaped drilling element is drilled, with the drilling drive of the construction working device, in particular into a ground. This can be an anchor, such as a bar anchor, a sheet pile wall anchor, a strand anchor or a helix anchor. However, posts or uprights can also be inserted into the ground using a different drill section. Such posts or uprights can form supporting elements, for example for solar panels.

BRIEF DESCRIPTION OF THE DRAWINGS

The invention is described further below with reference to preferred exemplary embodiments, which are shown schematically in the drawings. The drawings show in.

DETAILED DESCRIPTION

Figure 1:
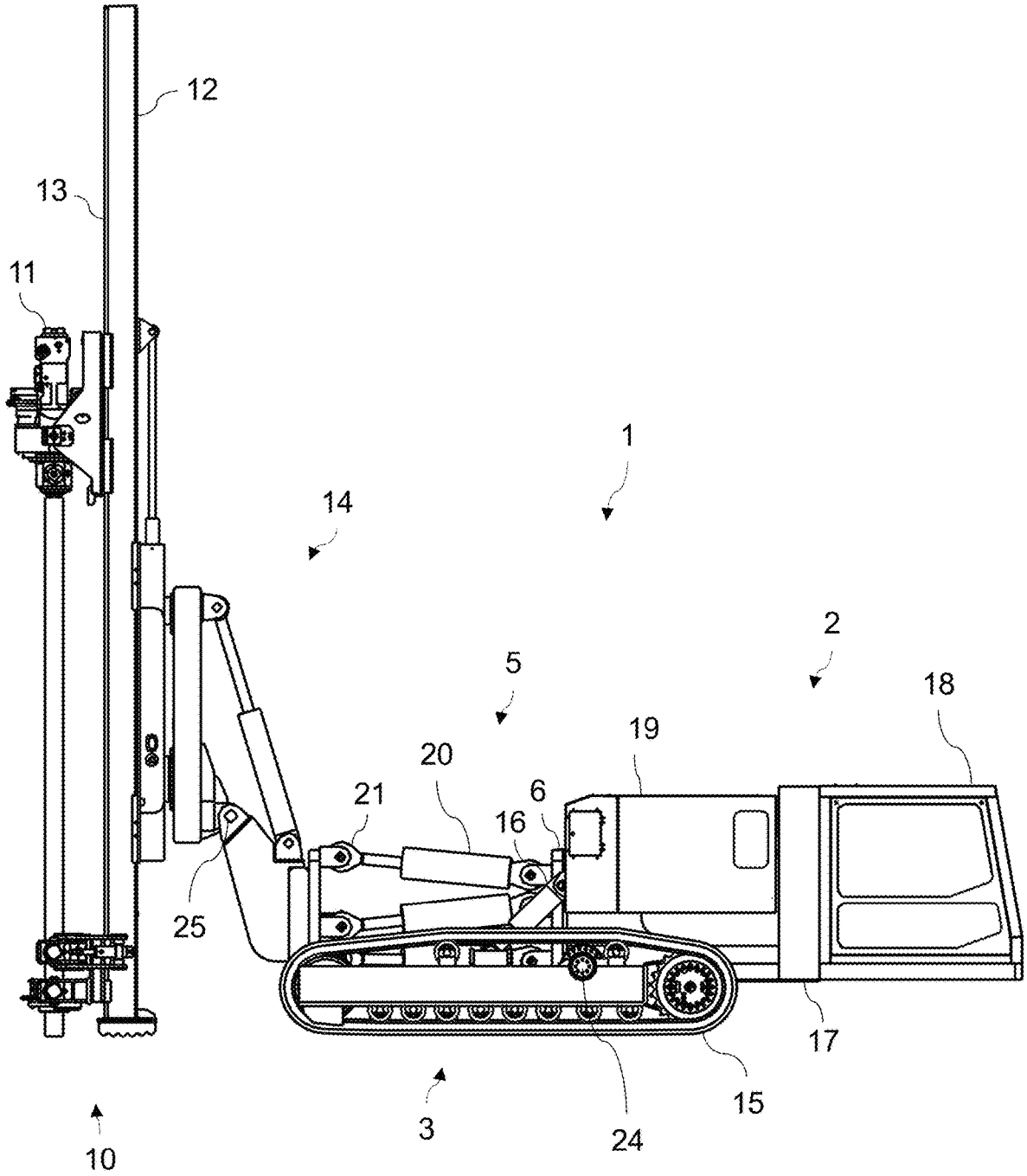
FIG. 1 a side view of a construction machine according to the invention.
Figure 2:
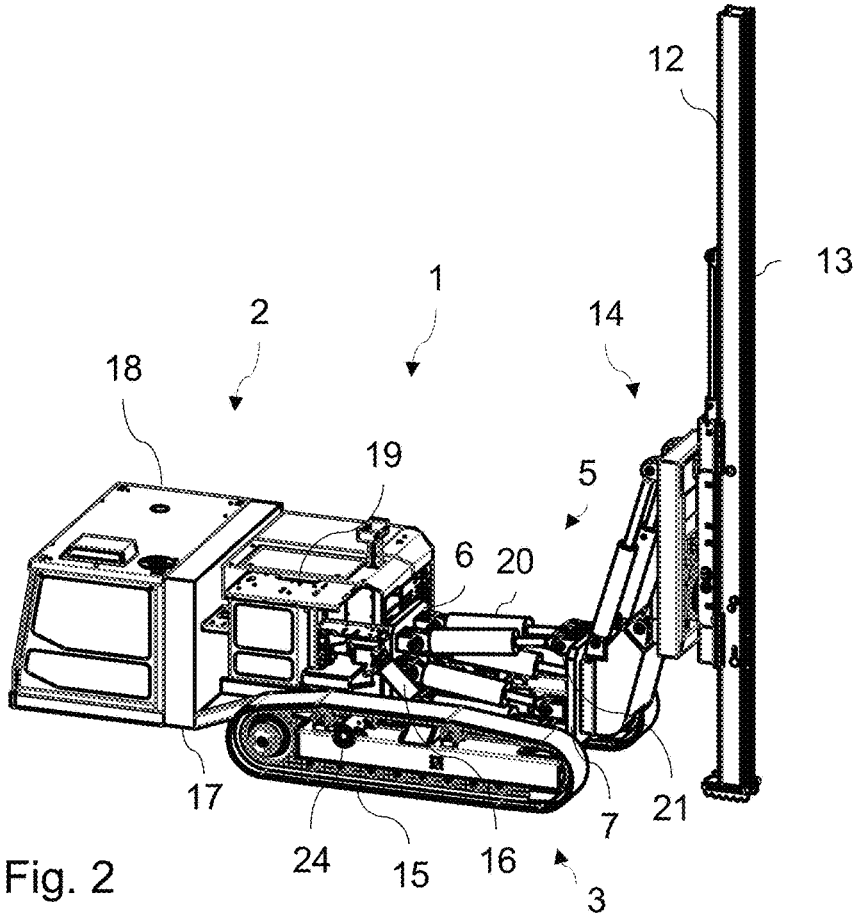
FIG. 2 a perspective view of a construction machine according to the invention without a construction working device.
Figure 3:
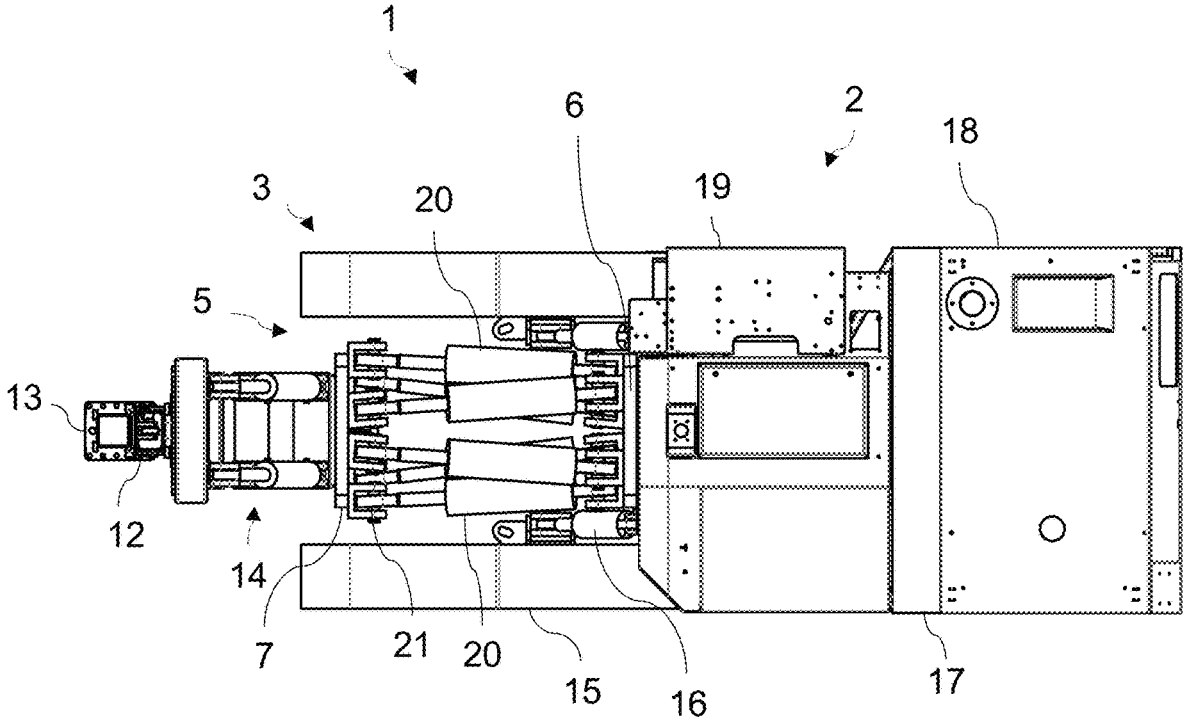
FIG. 3 a top view of a construction machine as shown in FIG. 2.

The basic structure of a construction machine 1 according to the invention is explained in conjunction with FIG. 1. The presentations of FIG. 2 and FIG. 3 show a further embodiment of a construction machine according to the invention without a construction working device 10.

A carrier device 2 is provided, which comprises a running gear 3 for moving the construction machine 1. The carrier device 2 is preferably designed as a crawler vehicle. Here, the running gear 3 comprises two lateral crawler tracks 15. Preferably, the crawler tracks 15 are swingably-mounted on a transverse axis 24 in the central area thereof, on a chassis 17 of the carrier device 2. Furthermore, external hydraulic actuating drives 16 can be arranged from the crawler tracks 15 to the chassis 17, which enable them to be adjusted about a transverse axis 24 of the carrier device 2. Furthermore, a drive unit 18 with, for example, a diesel engine and one or more hydraulic units are arranged on the chassis 17 in a rear area. Furthermore, a driver's cab 19 for controlling the construction machine 1 is arranged on the carrier device 2. According to a preferred embodiment variant, the carrier device 2 can be designed without a driver's cab 19 and can be controlled by an external control unit via a physical or non-physical connection.

A first base plate 6 of an adjusting device 5 is arranged on a front side of the carrier device 2. The first base plate 6 is fixedly connected to the carrier device. According to a preferred embodiment, however, the first base plate 6 can also be adjustably, in particular rotatably, articulated to the carrier device 2 so that the position and/or orientation of the adjusting device 5 itself can be adjusted. Furthermore, it may be preferred that further connecting elements are arranged between the first base plate 6 and the carrier device 2.

A second base plate 7 is arranged on a second side of the adjusting device 5, remote from the front side of the carrier device 2. This can preferably have similar dimensions to the first base plate 6. A carriage 12 together with a construction working device 10 is connected to the second base plate 7. The carriage 12 can preferably be connected to the second base plate 7 via a connecting device 14. For this purpose, it is preferable that the connecting device 14 is also designed with a suitable adjustment mechanism, which additionally allows the carriage 12 to be rotated about a longitudinal axis and/or to be tilted on a tilting axis 25. By tilting the carriage 12, for example, it can be tilted into a transport position in which the carriage 12 together with the drilling rig 10 lies horizontally above the carrier device 2. Tilting the carriage downwards around the tilting axis 25 for transportation may also be preferred. Furthermore, it may be preferable that other construction working devices that do not have a carriage 12 are also arranged on the second base plate 7 via a suitable connecting device.

Between the two base plates 6, 7 of the adjusting device 5 there is an arrangement of linearly adjustable and actuatable actuating elements 20. The actuating elements 20 are each articulated to both sides of the base plates 6, 7 via joints 21. The individual joints 21 can have different axes of movement as well as different numbers of axes of movement in various combinations. Preferably, the joints can be ball-and-socket joints or cardanic joints. However, simple rotational joints or linear joints can also be arranged, for example.

Depending on the application and the desired dynamics of the adjusting device, the actuating elements 20 can be arranged in different constellations. In a particularly preferred embodiment variant, the actuating elements are arranged in the form of a hexapod, also known as a Stewart platform. For this purpose, six actuating elements 20 are arranged in three areas each, preferably in a circumferential area, on the base plates 6, 7 in order to enable movements of the second base plate 7 in all six degrees of freedom. The actuating elements 20 each run diagonally to an adjacent area on the other base plate. Furthermore analog thereto, an arrangement in the form of a pentapod or tripod, for example, may be preferred in order to save weight and/or achieve other dynamic properties.

The actuating elements 20 can preferably be designed as hydraulic actuating drives. However, it may also be preferable to use other drive types such as pneumatic, piezoelectric or magnetic drives, for example to eliminate the need for lines such as hydraulic lines.

The carriage 12 is provided with a linear guide 13 on its front longitudinal side, along which a construction working device 10 is mounted so as to be axially displaceable, for carrying out a construction work step. The construction working device 10 can preferably be designed as a device for driving a rod-shaped drilling element in a rotatable manner. For this purpose, the construction working device 10 may comprise a drill drive 11 that can be displaced axially along the longitudinal axis of the carriage.

The invention claimed is:

1. A construction machine with a construction working device for carrying out a work step, the construction machine comprising:

a carriage, along the carriage longitudinal axis of which the construction working device is mounted so as to be axially displaceable, a carrier device with a running gear for moving the construction machine, and an adjusting device, by means of which the carriage is adjustably arranged at the front side of the carrier device, wherein the adjusting device comprises a first base plate, which is connected to the carrier device, and a second base plate, which is connected to the carriage, the first base plate and the second base plate are arranged at a distance from one another, actuating elements are arranged between the two base plates to connect the two base plates to one another in each case, the actuating elements are linearly adjustable and actuatable such that the base plates are adjustable relative to one another in three dimensions, and the actuating elements are the only connection between the two base plates.

2. The construction machine according to claim 1, wherein the actuating elements can be actuated kinematically in parallel.

3. The construction machine according to claim 1, wherein the actuating elements form a hexapod.

4. The construction machine according to claim 1, wherein the actuating elements are connected to the respective adjacent base plates via joints with several axes of movement.

5. The construction machine according to claim 1, wherein the construction machine comprises at least six identical actuating elements, which at one end are each articulated in pairs on three distributed areas of the first base plate and at the other end are each articulated in pairs on three distributed areas of the second base plate, wherein two actuating elements each articulated in one area are arranged in a V-shape relative to one another.

6. The construction machine according to claim 1, wherein the actuating elements are designed as hydraulic actuating cylinders.

7. The construction machine according to claim 1, wherein the actuating elements are designed as electromechanical actuating cylinders.

8. The construction machine according to claim 1, wherein the construction machine comprises a control device into which a position and/or orientation of the second base plate in space can be input and preset, and the control device is configured to actuate the actuating elements in such a way that the second base plate takes the preset position and/or orientation.

9. The construction machine according to claim 1, wherein the construction machine comprises a control device which is configured to maintain a position and/or orientation of the second base plate in space even if the position of the carrier device changes.

10. The construction machine according to claim 1, wherein the carrier device is designed as a crawler-type vehicle with lateral crawler tracks.

11. The construction machine according to claim 10, wherein the crawler tracks are articulated to the carrier device so as to be adjustable about a transverse axis of the carrier device.

12. The construction machine according to claim 1, wherein the construction machine is designed as a drilling rig, wherein the construction working device comprises a drill drive for rotatably driving a rod-shaped drilling element.

13. A method for carrying out a construction work step, wherein a construction machine according to claim 1 is used.

14. The method for performing a construction work step according to claim 13, comprising drilling a rod-shaped drilling element into a ground using a drill drive of the construction working device.

15. A construction machine with a construction working device for carrying out a work step, the construction machine comprising:

a carriage, along the carriage longitudinal axis of which the construction working device is mounted so as to be axially displaceable, a carrier device with a running gear for moving the construction machine, and an adjusting device, by means of which the carriage is adjustably arranged at the front side of the carrier device, wherein the adjusting device comprises a first base plate, which is connected to the carrier device, and a second base plate, which is connected to the carriage, the first base plate and the second base plate are arranged at a distance from one another, actuating elements are arranged between the two base plates to connect the two base plates to one another in each case, the actuating elements are linearly adjustable and actuatable such that wherein the base plates are adjustable relative to one another in three dimensions, and the construction machine comprises at least six identical actuating elements, which at one end are each articulated in pairs on three distributed areas of the first base plate and at the other end are each articulated in pairs on three distributed areas of the second base plate, wherein two actuating elements each articulated in one area are arranged in a V-shape relative to one another.

* * * * *